US012359360B2

(12) United States Patent
Drücker et al.

(10) Patent No.: US 12,359,360 B2
(45) Date of Patent: Jul. 15, 2025

(54) METHOD FOR OPERATING AN AUTOMATIC WASHING MACHINE, AND AUTOMATIC WASHING MACHINE

(71) Applicant: Miele & Cie. KG, Gütersloh (DE)

(72) Inventors: Markus Drücker, Gütersloh (DE); Magnus Kortenjann, Telgte (DE)

(73) Assignee: MIELE & CIE. KG, Gütersloh (DE)

( * ) Notice: Subject to any disclaimer, the term of this patent is extended or adjusted under 35 U.S.C. 154(b) by 282 days.

(21) Appl. No.: 17/915,586

(22) PCT Filed: Mar. 22, 2021

(86) PCT No.: PCT/EP2021/057257
§ 371 (c)(1),
(2) Date: Sep. 29, 2022

(87) PCT Pub. No.: WO2021/197894
PCT Pub. Date: Oct. 7, 2021

(65) Prior Publication Data

US 2023/0141282 A1 May 11, 2023

(30) Foreign Application Priority Data

Mar. 30, 2020 (DE) ..... 102020108714.4

(51) Int. Cl.
*D06F 34/16* (2020.01)
*D06F 33/32* (2020.01)
(Continued)

(52) U.S. Cl.
CPC ..... *D06F 34/16* (2020.02); *D06F 33/32* (2020.02); *D06F 33/48* (2020.02); *D06F 37/02* (2013.01);
(Continued)

(58) Field of Classification Search
CPC ..... D06F 2103/02; D06F 2103/24; D06F 2103/26
See application file for complete search history.

(56) References Cited

U.S. PATENT DOCUMENTS 5,897,672 A * 4/1999 Badami ..... D06F 34/18 68/12.04
2010/0205826 A1* 8/2010 Ashrafzadeh ..... D06F 34/18 34/88
(Continued)

FOREIGN PATENT DOCUMENTS

CN 104674532 A * 6/2015 ..... D06F 58/24
EP 2684990 A2 1/2014
JP 2010194216 A 9/2010

OTHER PUBLICATIONS

CN104674532A Machine Translation (Year: 2015).*

*Primary Examiner* — Spencer E. Bell
(74) *Attorney, Agent, or Firm* — Dickinson Wright PLLC

(57) ABSTRACT

A washing machine and method for operating a washing machine having a suds container and a non-ribbed drum. During rotation of the drum in a subcritical rotational speed range, the method includes determining an average value, a minimum, and a maximum of an oscillation of a physical variable relating to the drum or the motor, forming an overall average value from the determined average values, subtracting the overall average value formed from the corresponding minimum determined per oscillation and the corresponding maximum determined per oscillation to calculate a maximum value and a minimum value per oscillation, respectively. In each case an amount is formed from the respective calculated maximum value and an amount is formed from the respective calculated minimum value, a standard deviation from the amounts is determined, and a loading situation
(Continued)

where laundry is rolling in the drum is determined based on the determined standard deviation.

11 Claims, 1 Drawing Sheet

(51) Int. Cl.

| | |
|---|---|
| ***D06F 33/48*** | (2020.01) |
| ***D06F 37/02*** | (2006.01) |
| ***D06F 37/30*** | (2020.01) |
| ***D06F 103/02*** | (2020.01) |
| ***D06F 103/24*** | (2020.01) |
| ***D06F 103/26*** | (2020.01) |
| ***D06F 105/46*** | (2020.01) |

(52) U.S. Cl.
CPC ..... *D06F 37/304* (2013.01); *D06F 2103/02* (2020.02); *D06F 2103/24* (2020.02); *D06F 2103/26* (2020.02); *D06F 2105/46* (2020.02)

(56) References Cited

U.S. PATENT DOCUMENTS

| | | | | |
|---|---|---|---|---|
| 2011/0119839 | A1* | 5/2011 | Lilie | D06F 37/206 68/12.01 |
| 2013/0160216 | A1 | 6/2013 | Buendia et al. | |
| 2020/0149205 | A1* | 5/2020 | Jeoung | D06F 37/04 |

* cited by examiner

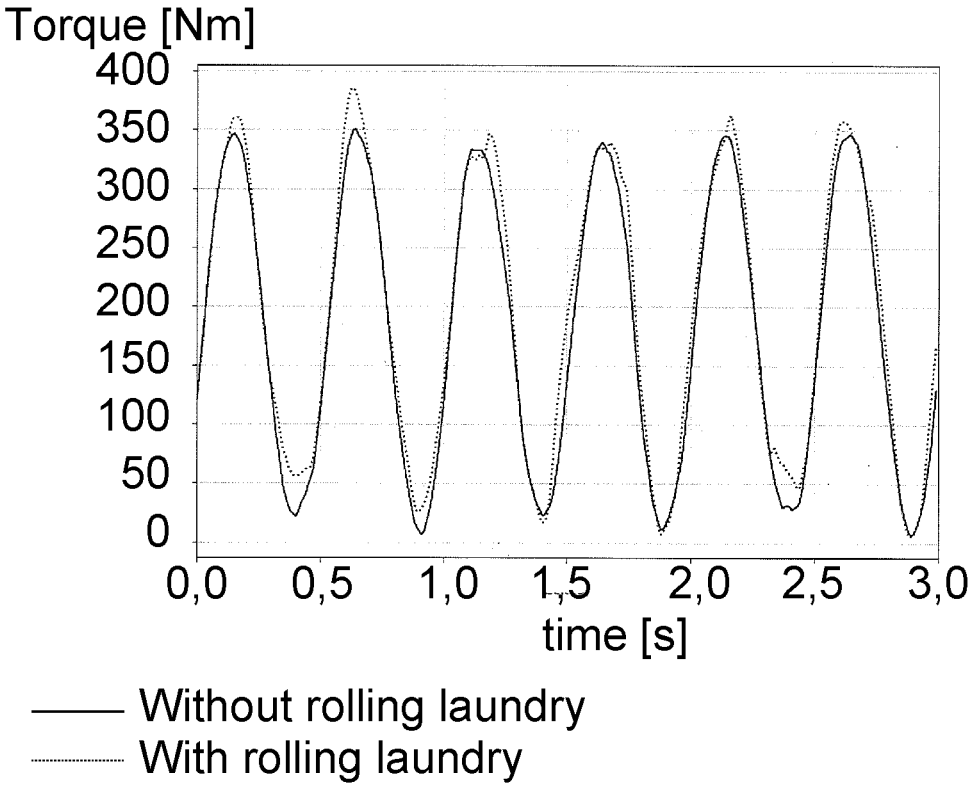
Torque [Nm]
400
350
300
250
200
150
100
50
0
0,0
0,5
1,0
1,5
2,0
2,5
3,0
time [s]
Without rolling laundry
With rolling laundry

METHOD FOR OPERATING AN AUTOMATIC WASHING MACHINE, AND AUTOMATIC WASHING MACHINE

RELATED APPLICATIONS

The present disclosure claims priority to and the benefit of PCT Application PCT/EP2021/057257, filed on Mar. 22, 2021, which claims priority to and the benefit of German Application 10 2020 108 714.4, filed on Mar. 30, 2020, the entire contents of which are incorporated herein by reference.

TECHNICAL FIELD

The disclosure relates to a method for operating a washing machine and to a washing machine. In particular, the disclosure relates to a method for operating a washing machine and to a washing machine having a non-ribbed drum.

BACKGROUND

Typically, washing machine drums have ribs inside. A rib, which is also referred to as an entraining element, is a part of the drum which, when the drum is moved, also causes the laundry inside the drum to execute a motion, i.e. it entrains the laundry. The rib is usually a plate in the drum on which the laundry located in the drum hangs up to a specific height during the rotation of the drum and then falls down again and in this way is swirled around and rearranged. Usually, there are a plurality of ribs in the drum, which are arranged at predetermined distances from one another. The ribs are substantial for the laundry to be rearranged while executing a washing program. However, the ribs are additional components that add cost. Therefore, a non-ribbed drum would be desirable.

In the development of a washing machine having a non-ribbed drum, however, we have discovered that there are laundry loads that do not lie in contact with the drum casing, but instead roll in the drum due to the lack of ribs. This behaviour is particularly problematic when the rolling laundry has a mass of 1 kg or more and is caused to lie in contact with the drum casing by a disturbance in the rolling movement, e.g., by the drum base, by the glass door of the washing machine, or by other items of laundry inside the drum. This suddenly creates an imbalanced mass which, due to its size, can cause the drum unit to hit a housing of the washing machine and can also cause the entire washing machine to move. In extreme cases, this can destroy the washing machine. In addition, rolling is problematic for delicate items of laundry. The longer an item of laundry rolls on the drum casing, the greater the risk that the textile will be damaged due to friction between the textile and the drum casing.

The disclosure therefore addresses the problem of providing a method for operating a washing machine and a washing machine having a non-ribbed drum in which the occurrence of rolling laundry when the drum is rotating can be detected, in particular at a rotational speed in the subcritical rotational speed range.

SUMMARY

According to the disclosure, this problem is solved by a method having the features of claim 1 and by a washing machine having the features of claim 9. Advantageous embodiments and developments of the disclosure can be found in the subsequent sub-claims.

The advantages that can be achieved with the disclosure are that it offers an important prerequisite for the reliable operation of a washing machine having a non-ribbed drum. It protects the washing machine from destruction by detecting imbalances caused by rolling laundry, and thus also protects a user of the washing machine from getting hurt and protects the laundry washed in the washing machine from being damaged. The method therefore makes it possible to protect the washing machine and the laundry from damage. As a result of a detected loading situation where laundry is rolling in the drum, a predetermined action that is stored in the washing machine can be executed in order to prevent or at least reduce damage.

The disclosure relates to a method for operating a washing machine having a suds container for holding washing liquid, a non-ribbed drum which is rotatably mounted in the suds container for holding laundry, a motor for driving the drum, and a control device, wherein said method, during rotation of the drum in a subcritical rotational speed range, comprises the following steps:

- determining an average value, a minimum, and a maximum of an oscillation of a physical variable relating to the drum or the motor per complete revolution of the drum over a predetermined period of time in which a plurality of revolutions of the drum take place;
- forming an overall average value from the determined average values;
- subtracting the total or overall average value formed from the corresponding minimum determined per oscillation and the corresponding maximum determined per oscillation to calculate a maximum value and a minimum value per oscillation, respectively;
- forming in each case an amount from the respective calculated maximum value and in each case an amount from the respective calculated minimum value;
- determining a standard deviation from the amounts formed over the predetermined period of time; and
- detecting, based on the determined standard deviation, whether a loading situation where laundry is rolling in the drum is present.

The disclosure is based on the basic idea that rolling laundry in a washing drum differs from laundry lying in contact with the drum in that rolling laundry exerts impulses on the drum casing. They are caused by the surface of the rolling laundry, which in practice deviates from a perfect spherical shape. These impulses cause a braking of the peripheral speed of the drum and thus cause a deviation or difference between the target and actual rotational speed of the drum. This behaviour can be evaluated mathematically by determining the average value as well as the minimum and maximum for each complete oscillation, i.e., one drum revolution. In the next calculation step, depending on the duration of the evaluation, the average value of all signal values is subtracted from all determined maxima and minima, and the absolute value is formed from the results. If the standard deviation is formed from these amounts as a measure for the fluctuation of the minima and maxima, then a loading situation where laundry is rolling in the drum, i.e., where the drum is loaded with rolling laundry, can be detected. According to the disclosure, depending on the determined standard deviation, the method detects whether or not laundry is rolling in the drum. If it is determined in the method according to the disclosure that a loading situation where laundry is rolling in the drum is present, a predetermined action that is stored in the washing machine is preferably executed to prevent or at least reduce the rolling of the laundry.

A non-ribbed drum is a drum that does not have any ribs or entraining elements inside it. However, it can have other elevations and/or depressions that do not have the shape of the plate-shaped rib or entraining element. The drum, preferably the drum casing, preferably has depressions and/or elevations other than a rib, for example in the form of stamped portions. It preferably has honeycombs, each of which is designed as an elevation or a depression.

In order for a loading situation where laundry is rolling in the drum to be present, it is not necessary for the entire laundry to roll in the drum; rather, it is sufficient if some of the laundry rolls in the drum. A loading situation where laundry is not rolling is present when all of the laundry is in contact with the drum casing.

The variable is sampled in order to determine the average value, the maximum, and the minimum of the oscillation of the physical variable that occurs per complete revolution of the drum over the predetermined period of time. The sampling of the variable preferably takes place at a predetermined frequency. The predetermined frequency for sampling is preferably high and is, for example, 100 Hz.

In a preferred embodiment, the physical variable relating to the drum or the motor is preferably an actual rotational speed of the drum or a variable that correlates with the actual rotational speed. Alternatively, the physical variable relating to the drum or the motor is a torque of the motor or a variable correlating with the torque of the motor. More preferably, the variable is the torque of the motor or the actual rotational speed of the drum. More preferably, the variable is the torque.

In a preferred embodiment, a loading situation is detected where laundry is rolling in the drum if the standard deviation determined is greater than a predetermined limit value. The predetermined limit value is preferably stored in the washing machine. The method therefore preferably also includes a comparison of the ascertained standard deviation with the predetermined limit value.

A plurality of limit values can also be stored in the washing machine, which depend, for example, on the rotational speed of the drum at which the variable is sampled over the predetermined period of time and/or which depend on the load amount. The larger the load amount, the greater the problems described above where laundry is rolling. Furthermore, a plurality of limit values can also be stored in the washing machine, which depend, for example, on the textile type to be subjected to the washing program, which is defined by the user adjusting the washing program when the washing program is started. Rolling is much more problematic for delicate laundry such as silk or wool than for less delicate laundry such as cotton laundry because the risk of damage due to friction between the textile and the drum casing is greater.

If a loading situation where laundry is rolling in the drum is detected, a predetermined action is preferably also executed. The predetermined action is preferably executed if the determined standard deviation is greater than the predetermined limit value.

The predetermined action is preferably stopping the rotation of the drum or continuing the rotation of the drum with a rocking process.

In a preferred embodiment, the rotation of the drum is stopped if a loading situation where laundry is rolling in the drum is detected. Preferably, when the rotation of the drum is stopped, the rotational speed of the drum is set to 0 rpm, and after setting the rotation speed of the drum to 0 rpm, the drum can then be rotated again.

In another preferred embodiment, the rotation of the drum is continued in a rocking process if a loading situation where laundry is sliding in the drum is detected. When the rotation of the drum is continued in a rocking process, the drum is driven in a right-left motion by means of the motor so as to cause a rocking motion of the laundry at a predetermined rocking frequency. As a result, the drum does not complete a complete revolution, but rather rocks from left to right and vice versa.

If the standard deviation is less than or equal to the predetermined limit value, a loading situation where laundry is not rolling in the drum is preferably detected. If a loading situation where laundry is not rolling in the drum is detected, the washing program is preferably continued without executing the predetermined action.

The rotational speed at which the drum is to be rotated during the method is in the subcritical range. The target rotational speed is preferably greater than a contact rotational speed at which the laundry should be in contact with the drum casing. At a target rotational speed of 70 rpm, the laundry is usually on the drum casing. The subcritical rotational speed range is therefore preferably a range with rotational speeds of equal to or greater than 70 rpm. The subcritical rotational speed range is more preferably in the range of from 70 to 149 rpm. More preferably, the rotational speed of the drum at which the drum is to be rotated in the method is in the range of from 120 to 149 rpm. The target rotational speed is preferably kept constant during the sampling of the variable in order to determine the average value, the maximum, and the minimum of the oscillation of the physical variable that occurs per complete revolution of the drum over the predetermined period of time.

The actual rotational speed of the drum can deviate from the target rotational speed depending on the imbalance that occurs. At rotational speeds from approx. 70 rpm, the laundry usually lies in contact with the drum casing. Since in practice the laundry is never completely evenly distributed on the drum casing, an imbalance of varying magnitude is formed depending on the distribution of the laundry. This imbalance causes a sinusoidal actual rotational speed signal that fluctuates slightly around the target rotational speed. If the imbalanced mass has to be raised, the speed of rotation of the drum slows down. The motor control compensates for this by increasing the motor torque. If the drum has rotated by half a revolution, the imbalance supports the rotational motion with its mass. The drum rotates slightly faster than the specified target rotational speed. Torque must be reduced to reduce actual rotational speed. This oscillation of the actual rotational speed occurs once per drum revolution and is very even, since the physical variables that determine it, such as imbalanced mass, lever arm, and drum speed, do not change. Just like the actual rotational speed of the drum, the torque required to drive the drum also has a uniform sinusoidal curve.

In a preferred embodiment, the torque of the motor is increased when an actual rotational speed of the drum is less than a target rotational speed of the drum and decreased when the actual rotational speed of the drum is greater than the target rotational speed of the drum. In addition to the impulses, which are caused by the rolling laundry on the drum casing, a fixed imbalance that occurs in practice and is applied to the drum at rotational speeds greater than the contact rotational speed at which a fixed imbalance is applied on the drum causes a difference between the actual and target rotational speeds, which is compensated by the controller of the motor by increasing and decreasing the torque. If at least some of the laundry is rolling in the drum, the rolling laundry that is not perfectly round exerts force impacts on the drum casing, so that, in addition to the deviation from the actual rotational speed to the target rotational speed caused by the fixed imbalance, another additional deviation now occurs randomly. If these impulses occur, they also brake the drum if the fixed imbalance has to be increased. If the fixed imbalance has rotated further by 180°, causing the rotational speed of the drum to increase, this increase in drum speed can be lower if an impulse caused by the rolling laundry occurs at this point in time. A consequence of these described physical effects is that the minima and maxima below and above the average value of the actual rotational speed of the drum as well as the engine torque fluctuate more than in the case described above where laundry is not rolling, in which case only the fixed imbalance occurs.

The predetermined period of time is preferably an integer multiple of a complete revolution of the drum. Preferably, the integer multiple is in the range of from 2 to 20, more preferably 3 to 10. For example, if the target rotational speed of the drum is 120 rpm, which corresponds to two complete revolutions of the drum per second, then the predetermined period of time may be, for example, 3 seconds, such that it comprises six complete revolutions of the drum. However, the method can also be carried out at any target rotational speed, wherein the predetermined period of time is adapted accordingly and is stored accordingly in the washing machine. The longer an item of laundry rolls on the drum casing, the greater the risk that the textile will be damaged due to the friction between the textile and the drum casing. The predetermined period of time is therefore preferably in the period of time of a few seconds. Preferably, the predetermined period of time is in the range of from 1 to 15 seconds. More preferably, the predetermined period of time is in the range of from 2 to 10 seconds. Even more preferably, the predetermined period of time is in the range of from 3 to 5 seconds.

The disclosure also relates to a washing machine having a suds container for holding washing liquid, a non-ribbed drum which is rotatably mounted in the suds container for holding laundry, a motor for driving the drum, and a control device that is designed and set up to execute a method according to any of the preceding claims.

Embodiments and advantages described for the method apply correspondingly to the washing machine and vice versa.

The washing machine can be a front loader or a top loader. The term "washing machine" also comprises a combination device such as a washer-dryer. The drum is preferably mounted in the suds container so that it can rotate horizontally.

The control device can be designed in one or more parts. In addition to regulating the rotational speed of the motor for driving the drum, it has other open or closed loop control means that are required to execute the washing program.

BRIEF DESCRIPTION OF THE DRAWINGS

An embodiment of the disclosure is described in more detail below with reference to a purely schematic drawing and an example. In the drawings:

FIG. 1 shows a partial curve of a torque in a time sequence.

DETAILED DESCRIPTION OF THE DRAWINGS

FIG. 1 shows a partial curve of a torque in a time sequence. FIG. 1 shows the partial curve of the torque of a motor of a washing machine executing a washing program and in a loading situation where laundry is rolling and where laundry is not rolling in its drum. FIG. 1 shows the time signal curve of the torque at a target rotational speed of the drum of 120 rpm. The partial curve of the torque is shown for a predetermined period of time of 3 seconds during which the drum completes six revolutions at two revolutions per second.

In the case of the solid line, the laundry lies completely in contact with the drum casing, so that the drum is free of rolling laundry, and a fixed imbalance has developed. This fixed imbalance causes the control of the motor per drum revolution to increase the torque relative to an average value, when increasing the fixed imbalance causes a braking of the actual rotational speed, and to decrease it relative to an average value, when decreasing the fixed imbalance causes an acceleration of the actual rotational speed. The solid line therefore shows the loading situation only with fixed imbalance where laundry is not rolling in the drum. The dashed line shows the loading situation with a fixed imbalance and where laundry is rolling in the drum. The torque waveform for the drum with fixed imbalance and where laundry is rolling in the drum, in which case the laundry does not completely contact the drum casing, as shown by the dashed line, differs from the torque waveform for the drum where laundry is not rolling in the drum.

Example

A washing machine has a suds container for holding washing liquid, a non-ribbed drum rotatably mounted in the suds container for holding laundry, a motor for driving the drum, and a control device having a motor controller. The washing machine runs a washing program where laundry is located in the drum. In the course of the washing program, the drum is rotated at a target rotational speed of 120 rpm. At least partially during the execution of the washing program, the control device determines a time curve of a torque of the motor. FIG. 1 shows the determined curve of the torque.

The following steps are now executed by the washing machine, in particular by the control device:

- determining an average value, a minimum, and a maximum of an oscillation of the torque occurring per complete revolution of the drum over the predetermined period of time, for example as shown in FIG. 1, in which a plurality—only as an example six—complete evolutions of the drum take place;
- forming an overall average value from the determined average values;
- subtracting the total or overall average value formed from the corresponding minimum determined per oscillation and the corresponding maximum determined per oscillation to calculate a maximum value and a minimum value per oscillation, respectively;
- forming in each case an amount from the respective calculated maximum value and in each case an amount from the respective calculated minimum value;
- determining a standard deviation from the amounts formed over the predetermined period of time; and
- detecting whether a loading situation where laundry is rolling in the drum is present, depending on the determined standard deviation.

Table 1 shows the corresponding minima and maxima of the signal curve of the engine torque for the case of the loading situation only with a fixed imbalance where laundry is not rolling in the drum, derived from FIG. 1, and the method steps described above, which result in the formation of the standard deviation.

TABLE 1

Presentation of the minima and maxima per drum revolution, subtraction of the total average value, formation of the amount, and end result of the standard deviation for the case of the loading situation where laundry is not rolling.

shows the corresponding minima and maxima of the signal curve of the engine torque for the case of the loading situation only with a fixed imbalance where laundry is not rolling in the drum, derived from FIG. 1, and the method steps described above, which result in the formation of the standard deviation.

| | | Without rolling laundry | | Overall average value: | | 182 |
|---|---|---|---|---|---|---|
| Drum revolution | 1 | 2 | 3 | 4 | 5 | 6 |
| Maximum [Nm] | 349 | 350 | 338 | 342 | 348 | 349 |
| Minimum [Nm] | 25 | 8 | 26 | 10 | 30 | 8 |
| | After subtracting the overall average value | | | | | |
| Drum revolution | 1 | 2 | 3 | 4 | 5 | 6 |
| Maximum [Nm] | 167 | 168 | 156 | 160 | 166 | 167 |
| Minimum [Nm] | −157 | −174 | −156 | −172 | −152 | −174 |
| | After formation of the amount | | | | | |
| Drum revolution | 1 | 2 | 3 | 4 | 5 | 6 |
| Maximum [Nm] | 167 | 168 | 150 | 160 | 166 | 167 |
| Minimum [Nm] | 157 | 174 | 156 | 172 | 152 | 174 |
| Total standard deviation: | | 7.62 | | | | |

The determined standard deviation is now compared with a predetermined limit value, which is stored in the washing machine and is 10, for example. The determined standard deviation is smaller than the predetermined limit value, so that the method detects that the drum has a loading situation where laundry is rolling in the drum. The drum continues to rotate at the target rotational speed of 120 rpm.

Table 2 shows the corresponding minima and maxima of the signal curve of the engine torque for the case of the loading situation with a fixed imbalance and where laundry is rolling in the drum, derived from FIG. 1, and the method steps described above, which result in the formation of the standard deviation.

TABLE 2

Presentation of the minima and maxima per drum revolution, subtraction of the total average value, formation of the amount, and end result of the standard deviation for the case of the loading situation where laundry is rolling in the drum.

| | | With rolling laundry | | Overall average value: | | 192 |
|---|---|---|---|---|---|---|
| Drum revolution | 1 | 2 | 3 | 4 | 5 | 6 |
| Maximum [Nm] | 359 | 382 | 349 | 341 | 358 | 356 |
| Minimum [Nm] | 52 | 25 | 20 | 12 | 48 | 13 |
| | After subtracting the overall average value | | | | | |
| Drum revolution | 1 | 2 | 3 | 4 | 5 | 6 |
| Maximum [Nm] | 166 | 189 | 156 | 148 | 165 | 163 |
| Minimum [Nm] | −141 | −168 | −173 | −181 | −145 | −180 |

TABLE 2-continued

Presentation of the minima and maxima per drum revolution, subtraction of the total average value, formation of the amount, and end result of the standard deviation for the case of the loading situation where laundry is rolling in the drum.

| | | After formation of the amount | | | | |
|---|---|---|---|---|---|---|
| Drum revolution | 1 | 2 | 3 | 4 | 5 | 6 |
| Maximum [Nm] | 166 | 189 | 156 | 148 | 165 | 163 |
| Minimum [Nm] | 141 | 168 | 173 | 181 | 145 | 180 |
| Total standard deviation: | | 15.01 | | | | |

The determined standard deviation is now compared with the predetermined limit value, which is stored in the washing machine and is 10, for example. The determined standard deviation is greater than the predetermined limit value, so that the method detects a loading situation where laundry is rolling in the drum. A predetermined action is also executed in the method since it was detected that the laundry is rolling in the drum. The predetermined action is stopping the rotation of the drum or continuing the rotation of the drum during a rocking process.

The invention claimed is:

1. A method for operating a washing machine having a suds container for holding washing liquid, a non-ribbed drum rotatably mounted in the suds container for holding laundry, a motor for driving the drum, and a control device, comprising the following steps while rotating the drum in a subcritical rotational speed range:

determining an average value, a minimum, and a maximum of an oscillation of a physical variable relating to the drum or the motor per complete revolution of the drum over a predetermined period of time in which a plurality of revolutions of the drum take place;

forming an overall average value from the determined average values;

subtracting the overall average value from the corresponding maximum determined per oscillation and the corresponding minimum determined per oscillation to calculate a maximum value and a minimum value per oscillation, respectively;

forming in each case an absolute value amount of the respective calculated maximum value and in each case an absolute value amount of the respective calculated minimum value;

determining a standard deviation from the amounts formed over the predetermined period of time; and detecting, based on the determined standard deviation, whether a loading situation where laundry is rolling in the drum is present, wherein a loading situation where laundry is rolling in the drum is detected if the standard deviation determined is greater than a predetermined limit value.

2. The method according to claim 1, wherein the physical variable relating to the drum or the motor is preferably an actual rotational speed of the drum or a variable that correlates with the actual rotational speed.

3. The method according to claim 1, wherein the physical variable related to the drum or the motor is a torque of the motor or a variable correlated with the torque of the motor.

4. The method according to claim 1, wherein if a loading situation where laundry is rolling in the drum is detected, a predetermined action is also executed.

5. The method according to claim 4, wherein the predetermined action is stopping the rotation of the drum or continuing the rotation of the drum with a rocking process.

6. The method according to claim 1, wherein the predetermined period of time is in the range of from 1 to 15 seconds.

7. The method according to claim 1, wherein the subcritical rotational speed range is in the range of from 70 to 149 rpm.

8. A washing machine having a suds container for holding washing liquid, a non-ribbed drum which is rotatably mounted in the suds container for holding laundry, a motor for driving the drum, and a control device that is designed and set up to execute a method according to claim 1.

9. The method according to claim 1, wherein the predetermined period of time is in the range of from 2 to 10 seconds.

10. The method according to claim 1, wherein the predetermined period of time is in the range of from 3 to 5 seconds.

11. The method according to claim 1, wherein the control device adjusts a signal to the motor driving the drum when the loading situation where laundry is rolling is detected.

* * * * *